US006585449B2

(12) United States Patent
Chen

(10) Patent No.: US 6,585,449 B2
(45) Date of Patent: Jul. 1, 2003

(54) ENVIRONMENT PROTECTING GUTTER DUCT STRUCTURE FOR A CONCRETE ROADWAY

(76) Inventor: Jui-Wen Chen, Room B, 10F, No. 415, Chung-Cheng Rd., Shu-Lin Town, Taipei Hsien (TW)

( * ) Notice: Subject to any disclaimer, the term of this patent is extended or adjusted under 35 U.S.C. 154(b) by 0 days.

(21) Appl. No.: 09/975,260

(22) Filed: Oct. 12, 2001

(65) Prior Publication Data

US 2003/0072611 A1 Apr. 17, 2003

(51) Int. Cl.[7] ..... E01C 11/22; E02B 13/00

(52) U.S. Cl. ..... 404/2; 404/36; 405/43; 405/46

(58) Field of Search ..... 404/2, 26, 31–36, 404/42, 44; 405/43, 302.7, 46, 50, 302.2; 52/302.1

(56) References Cited

U.S. PATENT DOCUMENTS 3,561,177 A * 2/1971 Agro et al. ..... 52/169.14
4,478,901 A * 10/1984 Dickens et al. ..... 428/120
4,621,942 A * 11/1986 Hill ..... 404/41
4,840,515 A * 6/1989 Freese ..... 405/45
5,449,246 A * 9/1995 Housley ..... 404/42
5,848,856 A * 12/1998 Bohnhoff ..... 405/36
6,095,720 A * 8/2000 Stark ..... 405/129.6
6,206,607 B1 * 3/2001 Medico et al. ..... 404/2
6,230,468 B1 * 5/2001 Klaus ..... 52/741.11

* cited by examiner

*Primary Examiner*—Thomas B. Will
*Assistant Examiner*—Raymond W Addis
(74) *Attorney, Agent, or Firm*—Dennison, Schultz & Dougherty

(57) ABSTRACT

A gutter duct structure for a concrete roadway mainly comprises a plurality of duct elements each is formed as a hollow cone shaped strut with an opening at each end thereof, and a plurality of seal elements engageable respectively with a top openings of the duct elements. During constructing the roadway, the duct elements are laid on the ground with the bottom end of the duct elements buried in a water seeping layer. The seal elements may be removed rapidly after a top surface layer of the roadway is laid and finished thereby to channel water on the top surface layer to the water seeping layer for draining, and thus may speed up construction of the roadway and reduce costs, and allows rainfall seeping into earth for recycling to conform to environmental conservation and protection requirements.

6 Claims, 10 Drawing Sheets

ENVIRONMENT PROTECTING GUTTER DUCT STRUCTURE FOR A CONCRETE ROADWAY

BACKGROUND OF THE INVENTION

1. Field of the Invention

This invention relates to an environment protecting gutter duct structure for a concrete roadway and particularly a gutter duct structure for channeling water on the concrete roadway top surface to prevent water from accumulating on the roadway top surface and to recycle rainfall in the earth to better meet environmental protection requirements.

2. Description of the Prior Art

Conventional concrete roadways are usually constructed by pouring concrete on a prepared ground, leveling the roadway, and paving a top surface layer on the leveled roadway. As the gaps between various layers are filled with concrete, and since concrete has poor water permeability, water or rainfall on the top surface layer tends to be trapped and accumulated without seeping underground to the earth and soil beneath the roadway. As a result, ground water is not sufficiently replenished and could cause harmful effect to the environments. To remedy this shortcoming, some roadways have included a water seeping layer. However the water seeping layer laid below the concrete top layer has litte effect due to water impermeability of the concrete top layer. To make the water seeping layer effective, it must be exposed to the top layer. In general, the water seeping layer is vertically laid. Hence openings have to be reserved during pouring the concrete, when the water seeping layers are filled into the openings. Such kind of construction takes lot of time. Moreover, the strength and appearance of the top surface layer will suffer accordingly. It is not a desirable method or technique.

SUMMARY OF THE INVENTION

In view of aforesaid disadvantages, it is a primary object of the invention to provide a gutter duct structure for a concrete roadway that has duct elements coupled with removable seal elements to channel water to a water seeping layer laying horizontally on the bottom layer of the roadway to achieve better draining.

Another object of the invention is to provide a gutter duct structure for a concrete roadway that has prefabricated and integrated duct elements and removable seal elements to cover the opening of the duct elements for speeding up construction of the roadway and to prevent concrete or other external objects from entering into the duct elements during the construction processes. The duct elements may be freed from clogging and the seal elements may be removed rapidly to allow water to flow to the bottom ends of the duct elements disposing of the water in the water seeping layer below the concrete top surface layer. Thus water and rainfall will be channeled from the top openings of the duct elements into the soil to recycle rainfall without being trapped on the top surface layer of the roadway. The invention offers excellent water permeability to the top surface layer.

A further object of the invention is to provide a gutter duct structure for water seeping concrete roadway that has unit brackets with top rims leveled with the top openings of the duct elements.

To attain the foregoing objects, the gutter duct structure of the invention mainly includes a plurality of duct elements coupled with seal elements. The duct elements are hollow struts. Each seal element engages with an opening formed at one end of the duct element and may be removed to expose the opening after construction of the roadway top surface layer is finished. The bottom end of the duct element is buried in the water seeping layer. The seal elements may be removed rapidly to channel water from the top surface layer to the water seeping layer. Thus construction of the roadway is simpler, faster and has water draining effect, and has a lower cost and greater practicality.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
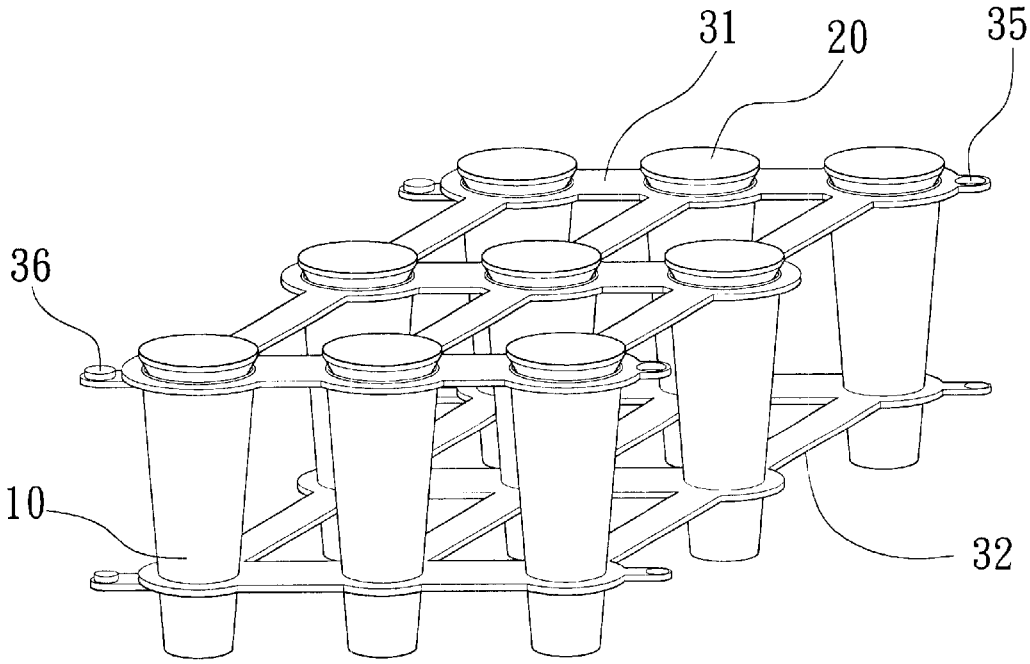
FIG. 1 is a perspective view of an embodiment of the invention.
Figure 2A:
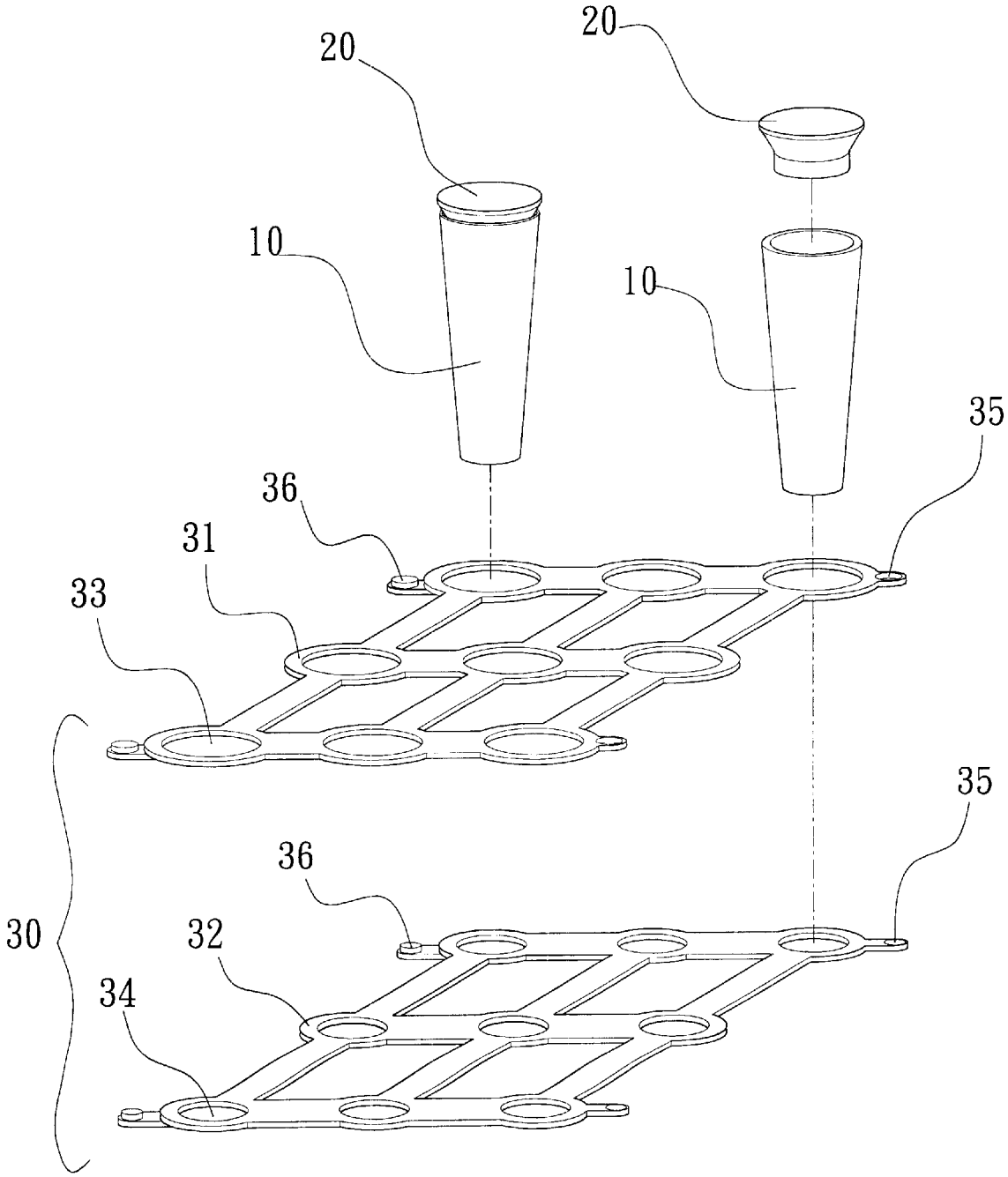
FIG. 2A is an exploded view of an embodiment of the invention.

Referring to FIGS. 1 and 2A, the gutter duct structure of the invention mainly consists of a plurality of duct elements 10, seal elements and a unit bracket 30. Each duct element 10 may be a hollow cylindrical strut. The seal element is a lid 20 for covering the opening at one end of the duct element 10. The unit bracket 30 includes an upper bracket 31 and a lower bracket 32.

As a preferred embodiment of the invention, the duct element 10 is formed in a cone shape. The upper bracket 31 and lower bracket 32 have respectively upper openings 33 and lower openings 34 which have diameters matching the upper and lower exterior diameters of the duct elements 10 for holding the duct elements 10 securely on the unit bracket 30. The upper bracket 31 has top rims matching the top openings of the duct elements 10 substantially in a horizontal manner. After the construction is finished, the color of the unit bracket becomes the color of the ditches of the top surface layer of the roadway. Hence there is no need for additional painting for the top surface layer and may reduce construction time and costs.

The unit bracket 30 may form a resistant surface such that it will prevent the duct elements form sinking during construction. The upper and lower bracket 31 and 32 will keep the duct elements 10 upright during construction without toppling or clogging at the bottom ends.

The unit bracket 30 further has jutting hooks 36 formed on one side and hanging apertures 35 formed on another side to allow multiple number of unit brackets 30 juxtaposing and engaging with one another to form various sizes or shape to suit different areas and increase its applicability.

Figure 2B:
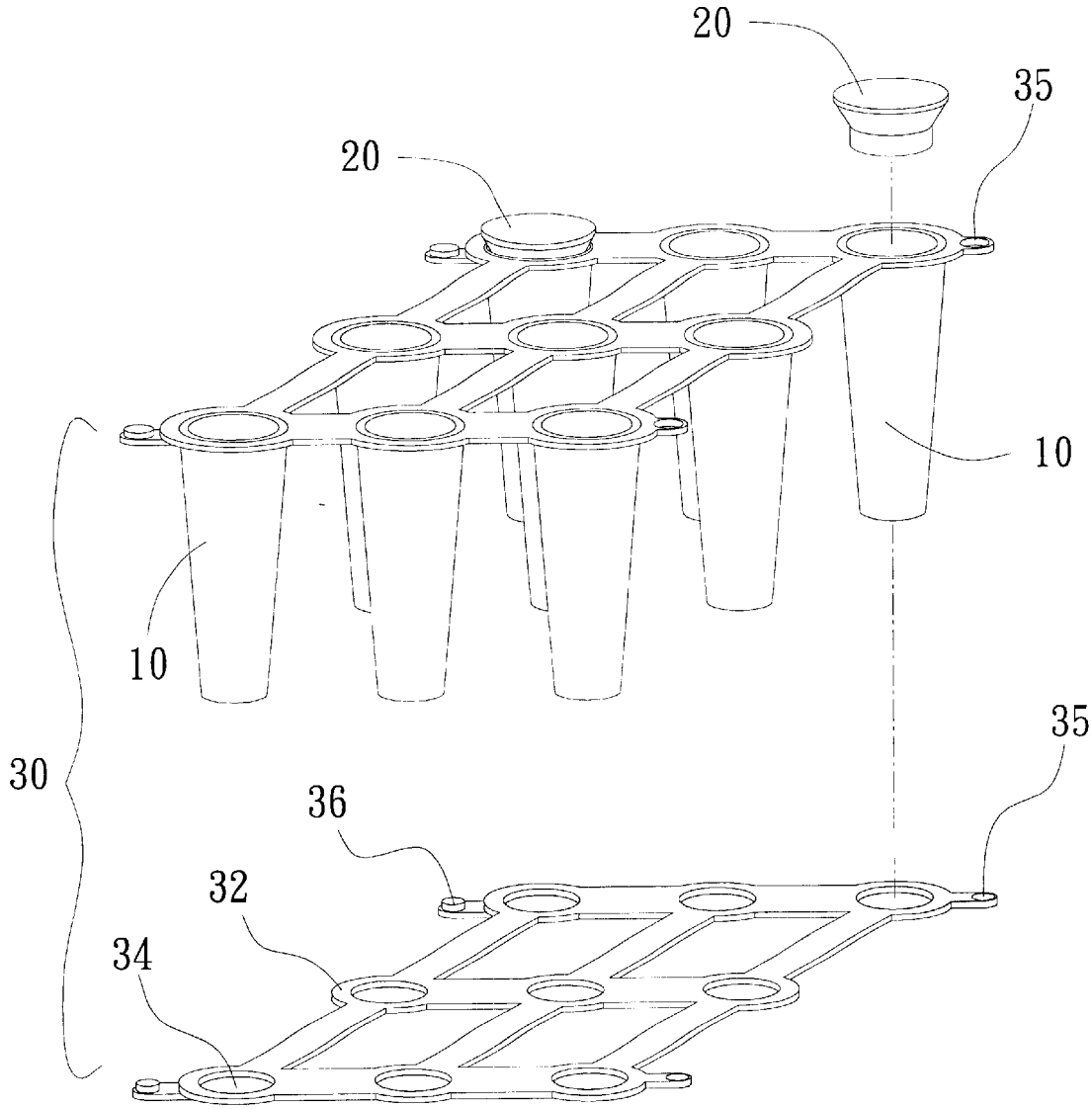
FIG. 2B is an exploded view of another embodiment of the invention.

Referring to FIG. 2B for another embodiment of the invention, the upper bracket 31 may be integrally formed with the duct elements 10 and may be coupled with the lower bracket 32 quickly for holding the duct elements 10.

When the assembled unit brackets are encased in the cured roadway, the interval between the upper and lower bracket 31 and 32 may be sandwiched with steel mesh layers to reinforce the strength of the concrete roadway. In fact, the structure of the upper and lower bracket 31 and 32 also can reinforce the strength of the concrete roadway.

Figure 3:
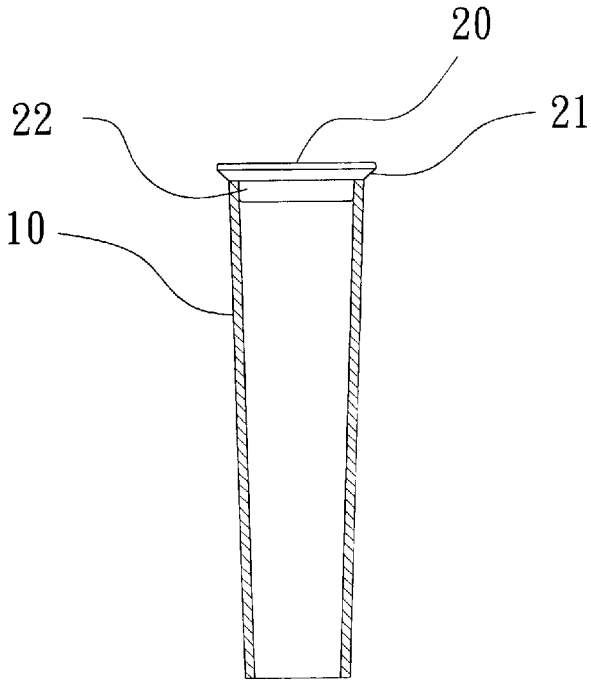
FIG. 3 is a sectional view of a duct element and a lid of the invention.

Referring to FIG. 3, the upper rim of the lid 20 has a chamfer angle 21 and an indented step level 22 extending downwards in the center of the lid. The chamfer angle 21 allows easier removing of the lid 20. The step level 22 has a same diameter as the interior of the duct element 10 to allow the lid 20 engaging with the duct element 10 securely without falling apart during construction.

During construction of the roadway top surface layer, first, lay a sand layer 42 as the water seeping layer, then place the assemble unit brackets 30 with the duct elements 10 on the sand layer 42 and bury the bottom ends of the duct elements 10 in the sand layer 42, then pour concrete 41. After the concrete 41 is cured and solidified, remove the lids 20 to complete the top surface layer of the roadway.

Figure 4:
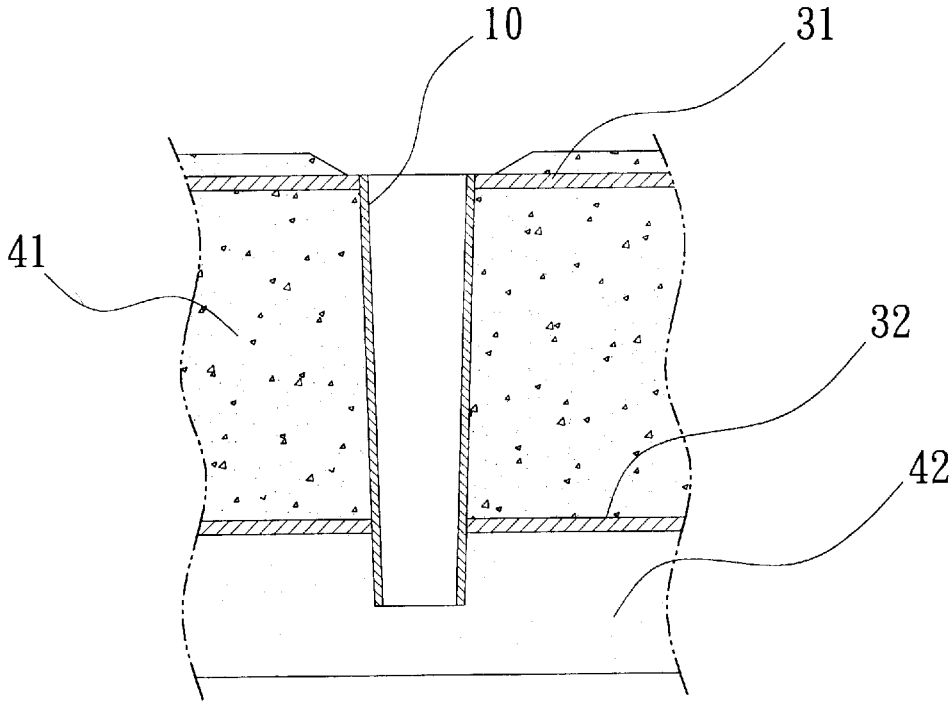
FIG. 4 is a sectional view of an embodiment of the invention in use.

The duct element 10 with the lid 20 removed has the top opening exposed to the top surface layer, and has the duct element running through the concrete 41 and the bottom end reaching the sand layer 42 to form a passage as shown in FIG. 4. Water or rainfall falling on the top surface layer of the roadway can flow through the passage to the sand layer 42. As the sand layer 42 has very good water permeability, it can drain water quickly without accumulating on the top surface layer.

By means of the passage formed by the duct element 10, the sand layer 42 may be spaced from water for a distance. Hence the sand layer 42 does not have to expose to the top surface layer for draining water on the top surface layer. The concrete 41 may be laid without the process of reserving water seeping ditches. Thus construction can be simplified, and the concrete 41 has a completed layer structure, and the top surface layer will have desired strength and finished appearance.

Figure 5:
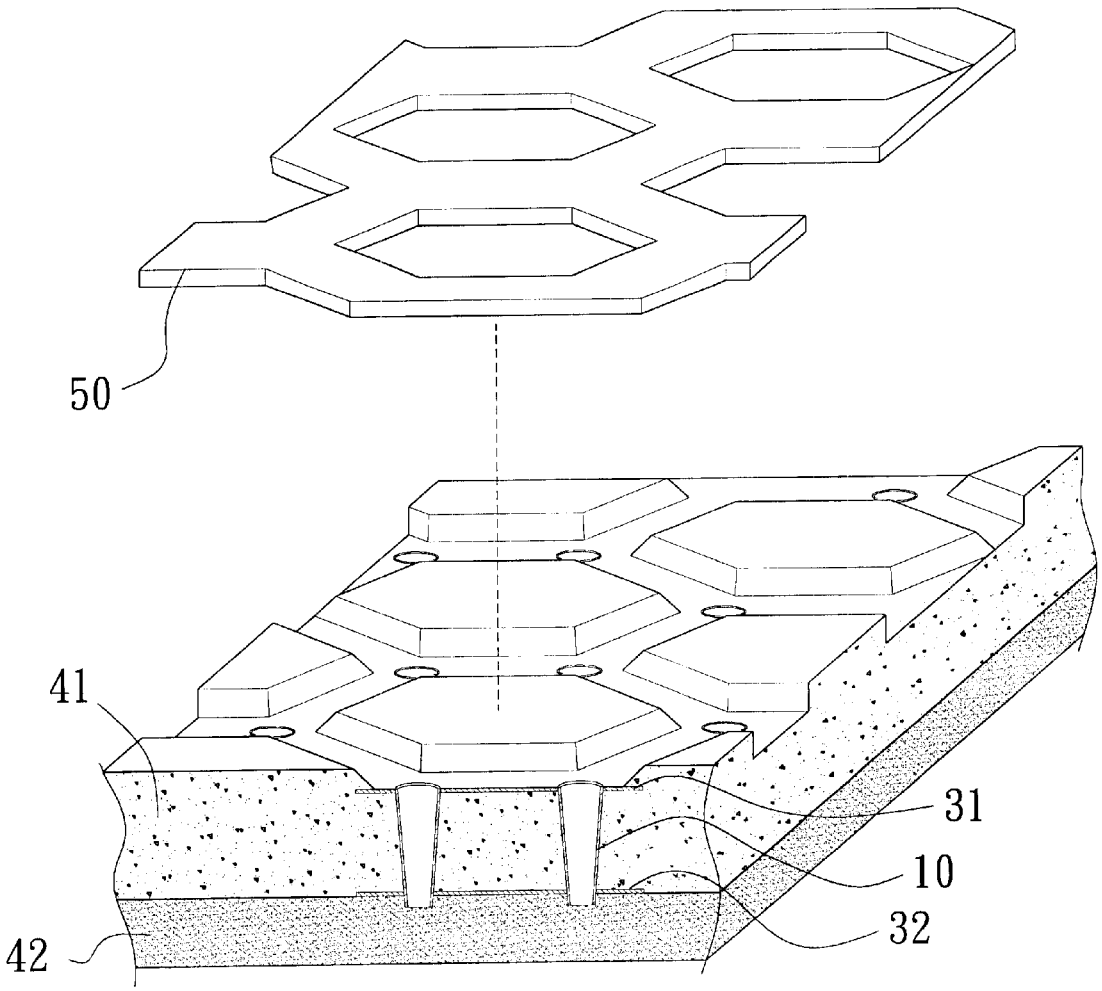
FIG. 5 is a schematic view of an embodiment of the invention in use.

Furthermore, because of the concrete 41 is a layer structure, a patterned mold plate 50 may be adopted to construct the top surface layer (as shown in FIG. 5). The unit bracket 30 and patterned mold plate 50 may be matched and coupled to form desired shapes or patterns, and to make the duct elements 10 wedging in the gaps of the top surface units to maintain good appearance. The sunk gaps become gutters to facilitate water discharge.

Through the duct elements 10 and unit brackets 30 of the invention, construction processes of water seeping concrete roadway become much simpler.

Figure 6:
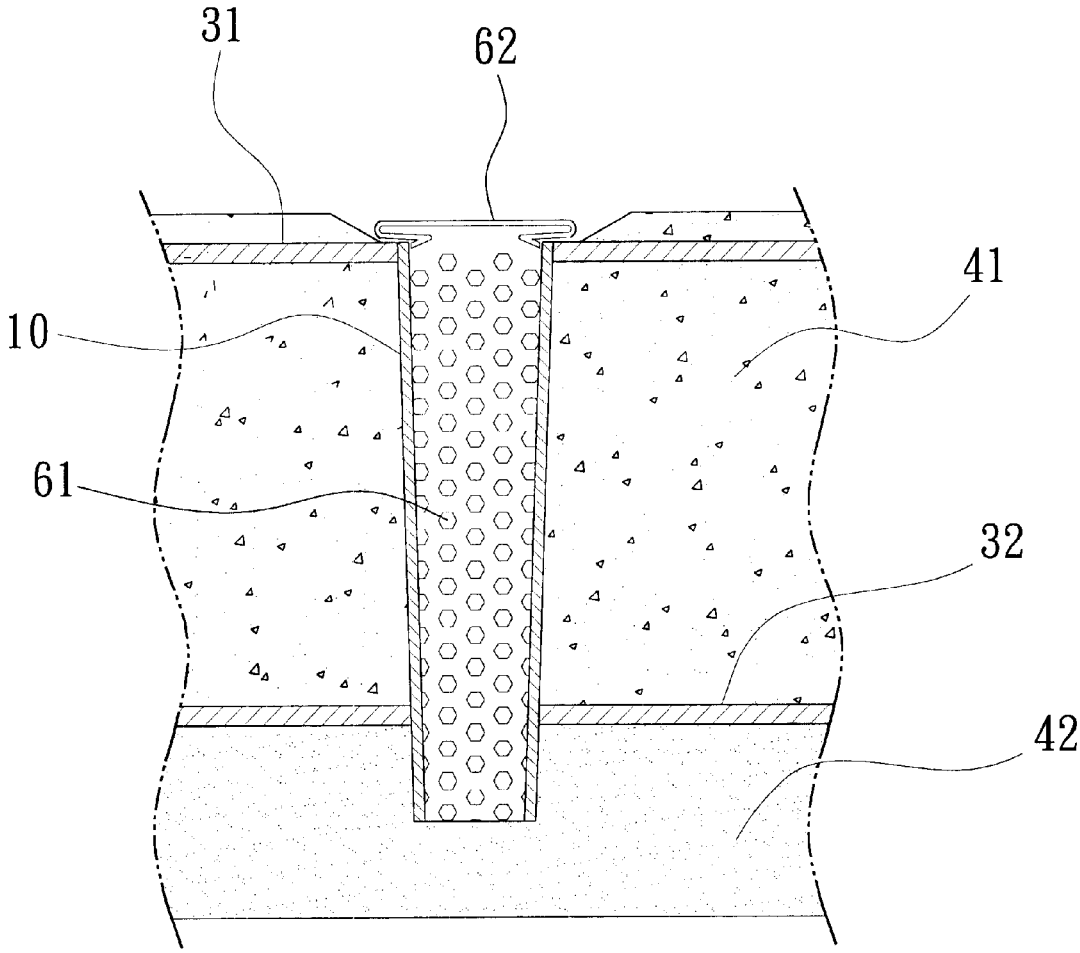
FIG. 6 is a sectional view of another embodiment of the invention in use.

Referring to FIG. 6 for another embodiment of the invention, the hollow interior of the duct element 10 may be filled with fine gravel 61 to prevent the duct element 10 form clogging by hairs, garbage, leaves, etc. Cleaning of the roadway may become easier to prevent water seeping effect impaired.

Figure 7:
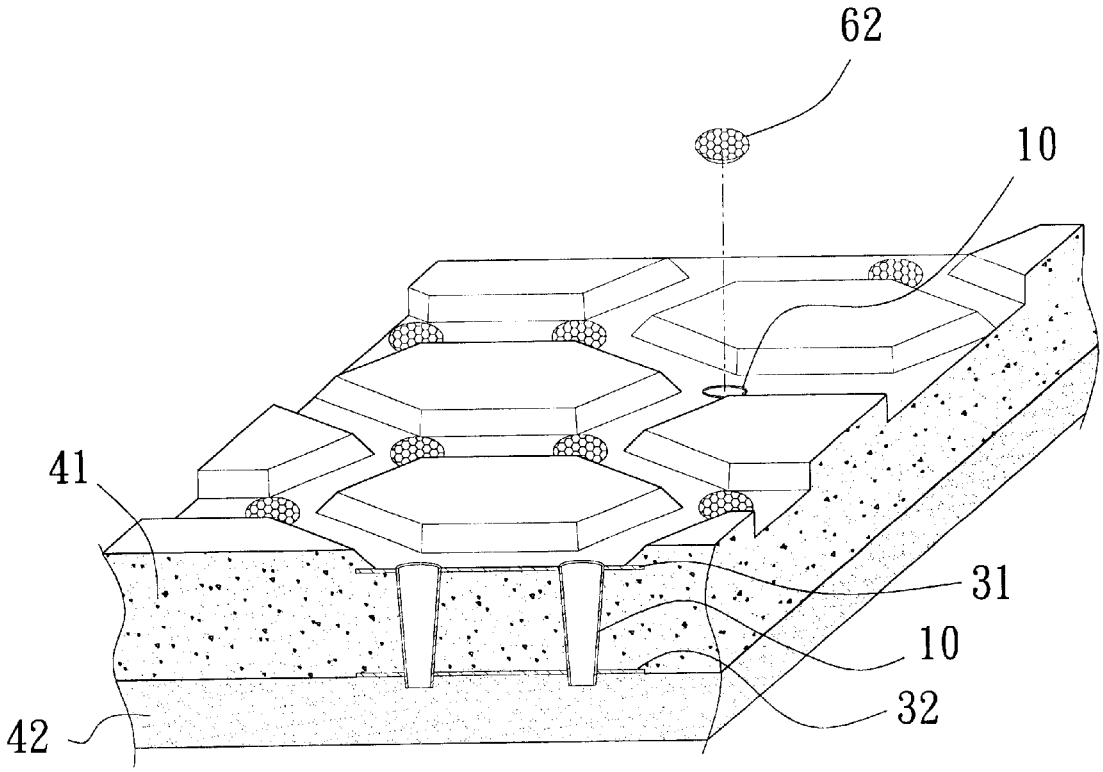
FIG. 7 is a schematic view of yet another embodiment of the invention in use.

Referring to FIGS. 6 and 7, the opening size of the duct element 10 may be chosen from a selected range. To avoid the finished roadway having too large of duct element openings and trapping women's heels, the top end opening of the duct element 10 may be covered by a stainless steel mesh lid 62. This also helps to filter and prevent external articles from entering and clogging the duct element 10.

Figure 8:
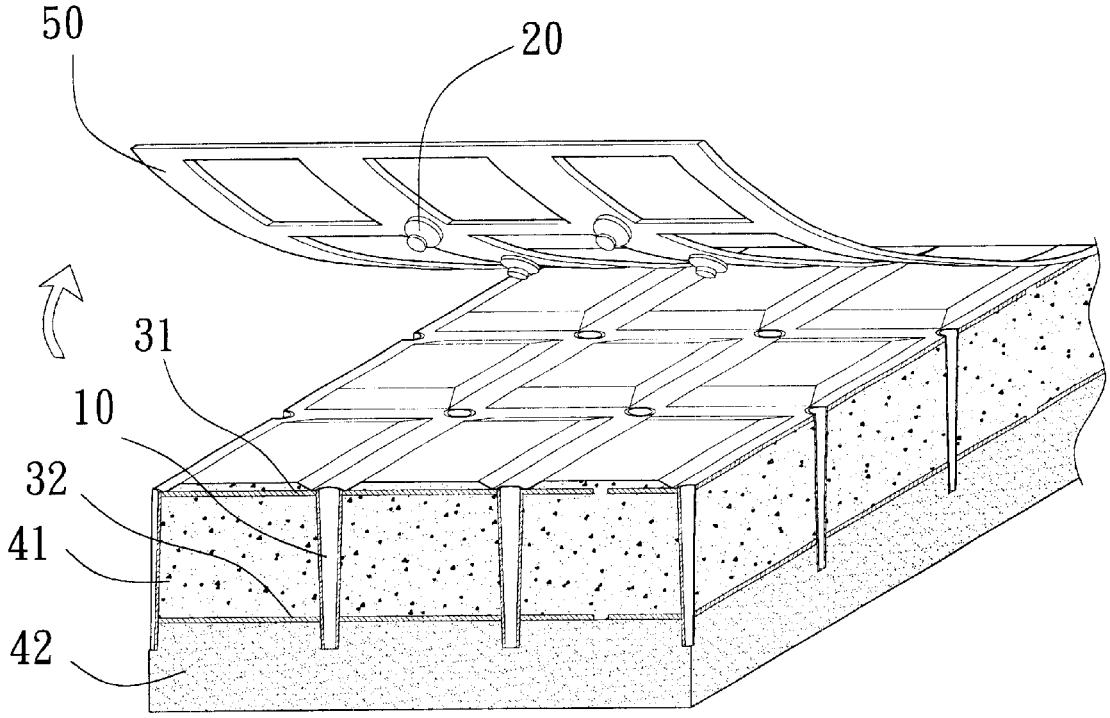
FIG. 8 is a schematic view of still another embodiment of the invention is use.

Referring to FIG. 8, in order to facilitate removing of the lids 20, a patterned mold plate 50 may be integrally formed with the lids 20. Hence multiple number of lids 20 may be removed during construction to further improve construction efficiency.

Figure 9:
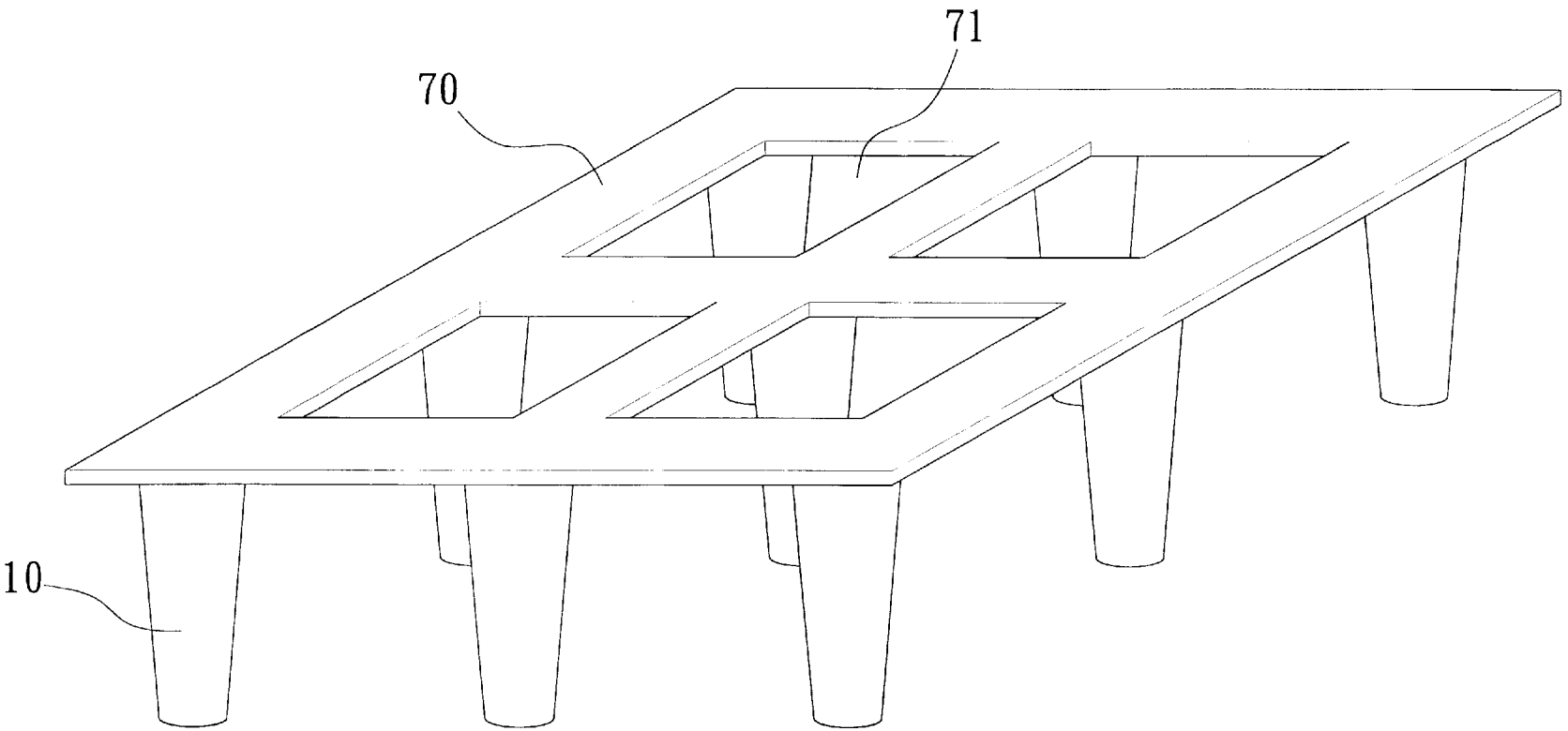
FIG. 9 is a perspective view of a further embodiment of the invention.
Figure 10:
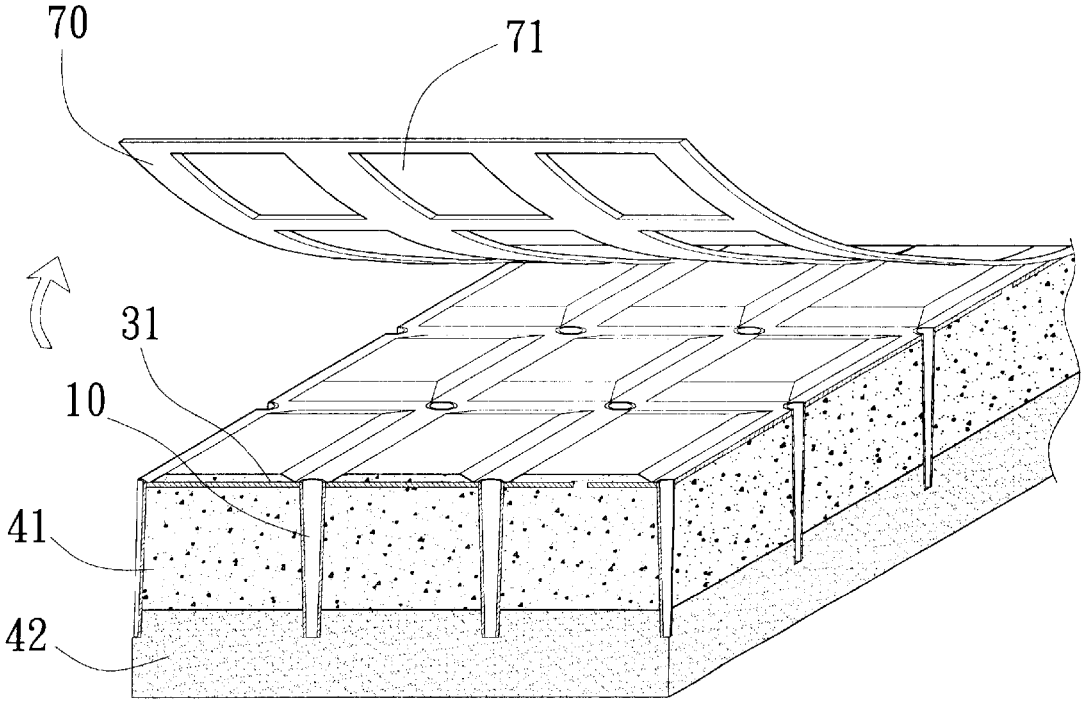
FIG. 10 is a schematic view of a further embodiment of the invention in use.

Referring to FIGS. 9 and 10, to facilitate rapid construction, the seal elements may be prefabricated in plants and to engage with the top openings of the duct elements 10 to become an integrated assembly. This also helps to prevent external articles form entering and clogging the duct elements during construction. The seal elements may be made from paper and coated with adhesive, or made form plastic membranes and bonded by thermosetting processes through automatic machinery. In the later case, a molded seal plate 70 with a plurality of openings 71 is provided. During construction, when concrete is poured and top surface layer is formed, the molded seal plate 70 may be removed quickly to increase total construction speed and to provide good water draining function.

In the FIGS. 5 through 8 and 10, the unit bracket 30 has the upper bracket 31 and lower bracket 32 to engage with the duct elements 10 at the upper and lower sections to maintain the duct elements at an upright position during construction. In actual practice, only the lower unit bracket 32 may be deployed to keep the duct elements 10 at the upright positions to simplify the structure and construction.

In summary, the invention has the following advantages:

1. The invention provides a plurality of duct elements to channel water to a water seeping layer, and the water seeping layer can be laid on the bottom of the roadway to save the processes of reserving ditches on the top surface layer.

The construction processes can be simplified and excellent water draining effect can be achieved.

2. The seal elements may be prefabricated in plants to couple integrally with the duct elements. Construction becomes much simpler. Concrete and external articles can be prevented from entering or clogging the duct elements during construction. After construction is finished, the seal elements may be removed rapidly. Water may be discharged through the passages formed in the duct elements without accumulating on the top surface layer. Rainfall may seep into the earth for recycling. Construction may be done easier and construction time may be reduced.
3. The top rim of the unit bracket is at the same horizontal level with the top openings of the duct elements. When the construction is finished, the color of the unit bracket is the same as the color of the ditches of the top surface layer. Construction time and costs may be saved.

While the preferred embodiments of the invention have been set forth for the purpose of the disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An environment protecting gutter duct structure for a concrete roadway, comprising:

a plurality of duct elements each being a hollow strut having a top and bottom opening therein: and a plurality of seal elements engageable with the top openings of the duct elements;

wherein the duct elements are laid on the ground during construction of a roadway and the seal elements are removed after a top surface layer of the road is laid and finished thereby to facilitate the construction of the roadway and achieve desired water draining effects for the roadway; and wherein the seal elements are made from plastic membranes and bonded by thermosetting processes through automatic machinery.

2. The environment protecting gutter duct structure of claim 1, wherein the duct elements are coupled to a unit bracket which has openings for holding the duct elements in upright positions.

3. The environment protecting gutter duct structure of claim 1, wherein the unit bracket includes an upper bracket and a lower bracket for holding an upper end and a lower end of the duct elements to keep the duct elements at upright positions.

4. The environment protecting gutter duct structure of claim 2, wherein the unit bracket includes an upper bracket which has a top rim to maintain a vertically level orientation with the openings of the duct elements.

5. The environment protecting gutter duct structure of claim 1, wherein the seal element is a lid and said lid has a chamfer angle formed on an upper rim thereof and is extended downwards in the center of the lid to form an indented step level which has the same diameter as the interior diameter of the duct element.

6. The environment protecting gutter duct structure of claim 1, wherein the duct element is covered by a stainless steel mesh on the top end thereof.

* * * * *